United States Patent [19]

Weinmann et al.

[11] 4,177,662

[45] Dec. 11, 1979

[54] MACHINE FOR THE MANUFACTURE OF AXIALLY PRESTRESSED COILS FROM STRIP

[76] Inventors: Günter Weinmann, Robert-Schumann-Str. 5, D-6053 Obertshausen; Heinz Vogel, Waldstrasse 13, D-6239 Diedenbergen, both of Fed. Rep. of Germany

[21] Appl. No.: 866,519

[22] Filed: Jan. 3, 1978

[30] Foreign Application Priority Data

Jan. 3, 1977 [DE] Fed. Rep. of Germany ..... 2700033

[51] Int. Cl.[2] ..... B21F 3/02; B21F 3/10; B21D 11/06

[52] U.S. Cl. ..... 72/138

[58] Field of Search ..... 72/135, 138, 146, 166, 72/169, 170, 173, 174, 175

[56] References Cited

U.S. PATENT DOCUMENTS

| | | | |
|---|---|---|---|
| 725,723 | 4/1903 | Kirk | 72/138 |
| 1,083,501 | 1/1914 | Lewis | 72/138 X |
| 1,676,598 | 7/1928 | Bleuel | 72/138 X |
| 2,110,665 | 3/1938 | Heilman et al. | 72/138 X |
| 2,176,719 | 10/1939 | Peyton | 72/146 |
| 3,342,052 | 9/1967 | Boy | 72/138 |
| 3,906,766 | 9/1975 | Sato | 72/138 X |

FOREIGN PATENT DOCUMENTS

| | | | |
|---|---|---|---|
| 646176 | 11/1950 | United Kingdom | 72/135 |

*Primary Examiner*—E. M. Combs

*Attorney, Agent, or Firm*—Blanchard, Flynn, Thiel, Boutell & Tanis

[57] ABSTRACT

A machine for the manufacture of an axially prestressed coil out of a strip of material for covering various types of machine components, such as spindles, shafts and columns. The coil is to have an elongated and spiral-like form. The machine which is capable of manufacturing this product includes a feed roller pair for feeding the strip by the use of an associated feed drive mechanism. The feed rollers are movable against one another through a clamping device. A bending roller is arranged at the exit from the feed rollers. A support structure is provided for the bending roller to facilitate a movement thereof to effect not only a cylindrical bending of the strip material but also, and upon a swivelling of the bending roller, a cylindrical as well as an increasing diameter spiral can be formed.

15 Claims, 4 Drawing Figures

MACHINE FOR THE MANUFACTURE OF AXIALLY PRESTRESSED COILS FROM STRIP

FIELD OF THE INVENTION

This invention relates to an elongated coil making device and, more particularly, relates to an elongated coil having a spiral-like form.

BACKGROUND OF THE INVENTION

Axially prestressed coils out of a strip, in particular a steel strip, are used lately in place of bellows as longitudinally changeable protective sleeves for the protection of spindles, shafts and columns on machines. They have the advantage over bellows of having a substantially longer life and need less space. Because of their self-elasticity they extend by themselves, so that in general only an abutment is required and a fastening thereof to the machine parts which move relative to one another is not necessary.

A problem is the manufacture of such coils because the strip must be deformed permanently in a manner that the individual windings rest on one another with as little space as possible. If the play between the windings is too small, the windings jam in one another and the coil does not change as desired, which can also result in damage to the machine part which must be protected. When the play between the windings is too great, one obtains on the one hand undesired gaps, through which large chips can move, and on the other hand at the given winding number a large outside diameter of the coil, which is undesirable because of the limited space requirements. In relationship to the longitudinal axis of the axially resilient pretensioned spiral, which will be identified in short as a coil hereinafter, the individual windings have different sloped positions depending on the extension length. From this results an additional problem for the correct dimensioning of the winding spacing. Thus it is important to correctly coordinate the bending radius and the incline of the strip.

The basic purpose of the invention is to produce a machine, with which an exact coordination between the bending of the strip and its pitch is possible.

The inventive machine for the manufacture of a conical coil from a strip is characterized by a feed roller pair for feeding the strip by the use of an associated feed drive mechanism and the feed rollers can be moved against one another by a pressing device, a bending roller which is arranged in front of the feed roller pair, a bearing member for supporting the bending roller or the feed roller pair and which can be pivoted by means of a swivel drive mechanism about an axis extending perpendicularly to the plane of the strip which exits from the feed rollers and a shifting drive mechanism for shifting the bending roller or the feed rollers transversely to their axis and the feed drive mechanism, the swivel drive mechanism and the shifting drive mechanism being coupled with one another.

With the inventive machine it is possible to precisely coordinate the feed of the strip against the bending roller, the pivoting of the bending roller and its transverse shifting. The radius of curvature of the respective winding is determined by the degree of the relative transverse shifting between the bending roller and the feed rollers, while the pitch is defined by the swivelling position of the bending roller about the axis which extends at a right angle to the strip. If now these two adjusting movements are coordinated with one another and additionally with the feed of the strip, it is possible to manufacture a coil having a very certain pitch and an exactly defined increase of the radius of curvature of the windings. During the manufacture of a coil, first, a small radius of curvature is provided, which then increasingly becomes larger, since the windings are wound onto one another in a spiral-shaped manner. The length, which one wants to reach when the coil is completely relaxed, depends on the number of windings and the selected pitch. At the start and at the end it is possible to manufacture cylindrical windings, as this is needed as a rule in order to hold the coils well at their ends.

It is possible to make both the bending roller pivotal and movable parallel to its axis and to arrange the feed rollers stationarily, and also to support the bending roller nonmovably and instead arrange the feed rollers to be movable. Also the movability of both the feed rollers and also of the bending roller is conceivable. As a rule it will, however, be preferable to make only the bending roller pivotal and movable parallel to its axis, because this can be done easier structurally than the pivotal and movable arrangement of the feed rollers.

An important characteristic is the pressing device, which permits a clamping of the relatively thin and wide strip in such a manner that a deformation of the strip to form a coil is possible, without permitting the strip to shift between the feed rollers.

Differing from the embodiment illustrated in the drawings, coordination of the various adjusting movements can also be achieved by the drive mechanisms each having separate hydraulic or electric drive motors, which are coupled through a control device. The joining of the different adjusting movements thus does not need to be mechanical like in the illustrated exemplary embodiment, but can be achieved also with different conventional means familiar to the man skilled in the art.

The machine can also be equipped with a rotatably movable and longitudinally shiftable abutment for the forward moving coil end. The rotary movability of the abutment can be achieved both by the abutment being freely rotatably supported, for example on a ball bearing, and is carried along by the coil, and also by the abutment having an abutment drive mechanism associated therewith which drives the abutment synchronously with the rotation of the forward moving coil. Such an abutment prevents the windings from springing apart, which can be the case with pitches which are greater than the strip width.

According to a further development of the invention, a rotating support is provided, for example a roller pair or a pipe, on which rests the forward moving coil and this support has a drive mechanism associated therewith which drives the support synchronously with the rotation of the forward moving coil. Such a support is mainly of an advantage, when long coils are supposed to be manufactured.

In order to be able to influence the tapered position of the windings with respect to the axis of the coil according to a development of the invention, it is provided that the bending roller is positioned inclined relative to the bending edge which cooperates therewith and the angle of the sloped position can be preferably adjusted. As a result, a perfect function can be achieved during every extended condition of the coil, namely a jamming is avoided with the smallest possible play between the windings.

BRIEF DESCRIPTION OF THE DRAWINGS

One exemplary embodiment of the invention is illustrated in a simplified manner in the already mentioned drawings, in which.

DETAILED DESCRIPTION

Figure 1:
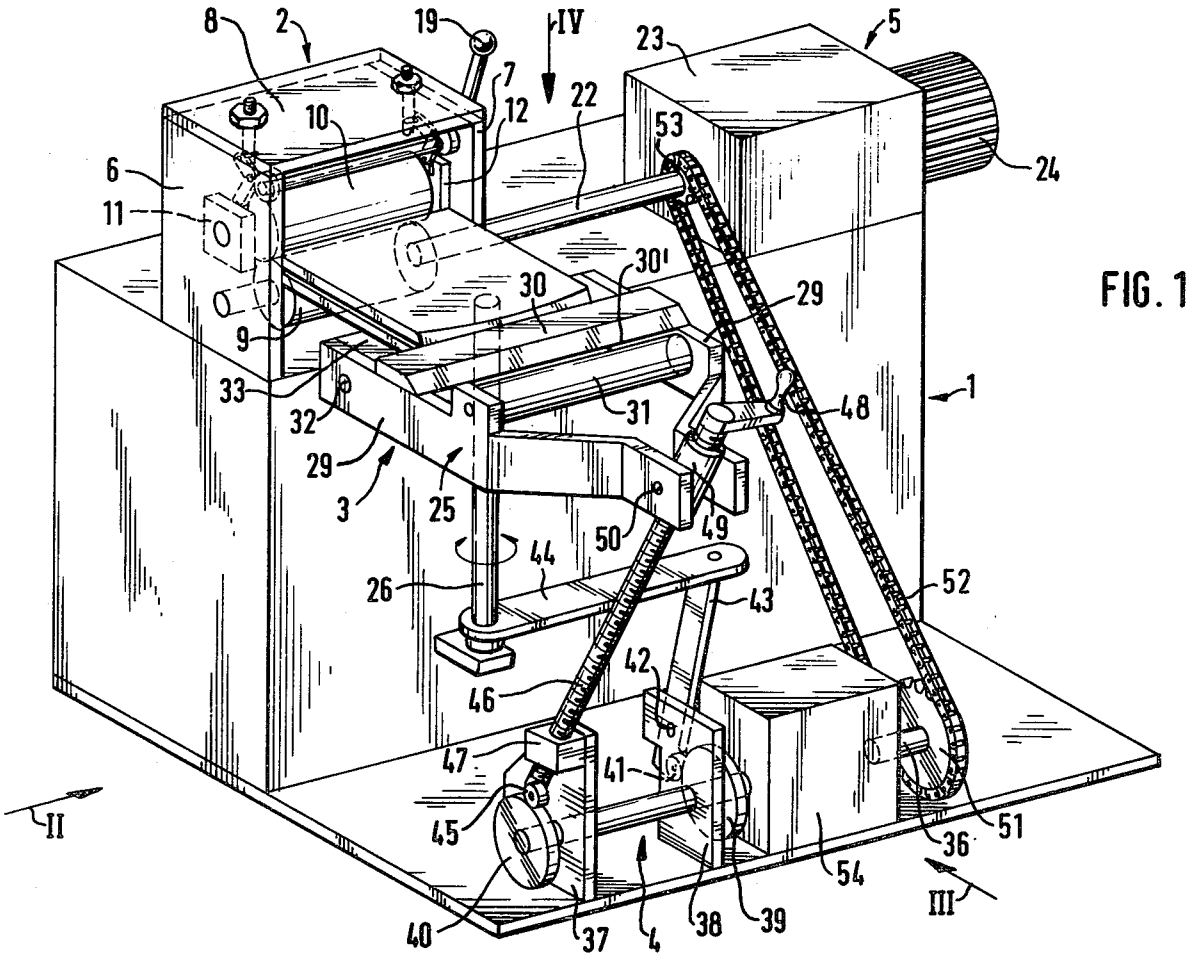
FIG. 1 is a perspective view of a device according to the invention.

The device has a frame 1, a feed roller pair 2, a rocker arm 3, in which a bending roller is supported, a drive mechanism 4 for moving the rocker arm and a motor 5 having a gearing connected to the output thereof. The character of these main groups and their cooperation will be described more in detail hereinbelow.

The feed roller arrangement has a bridge-shaped frame consisting of two side plates 6, 7 and a cross plate 8 which connects the side plates. A lower feed roller 9 is fixedly supported in the side plates 6, 7, while the upper feed roller 10 is rotatably supported in bearings 11, 12 and can be moved in a vertical direction.

Figure 2:
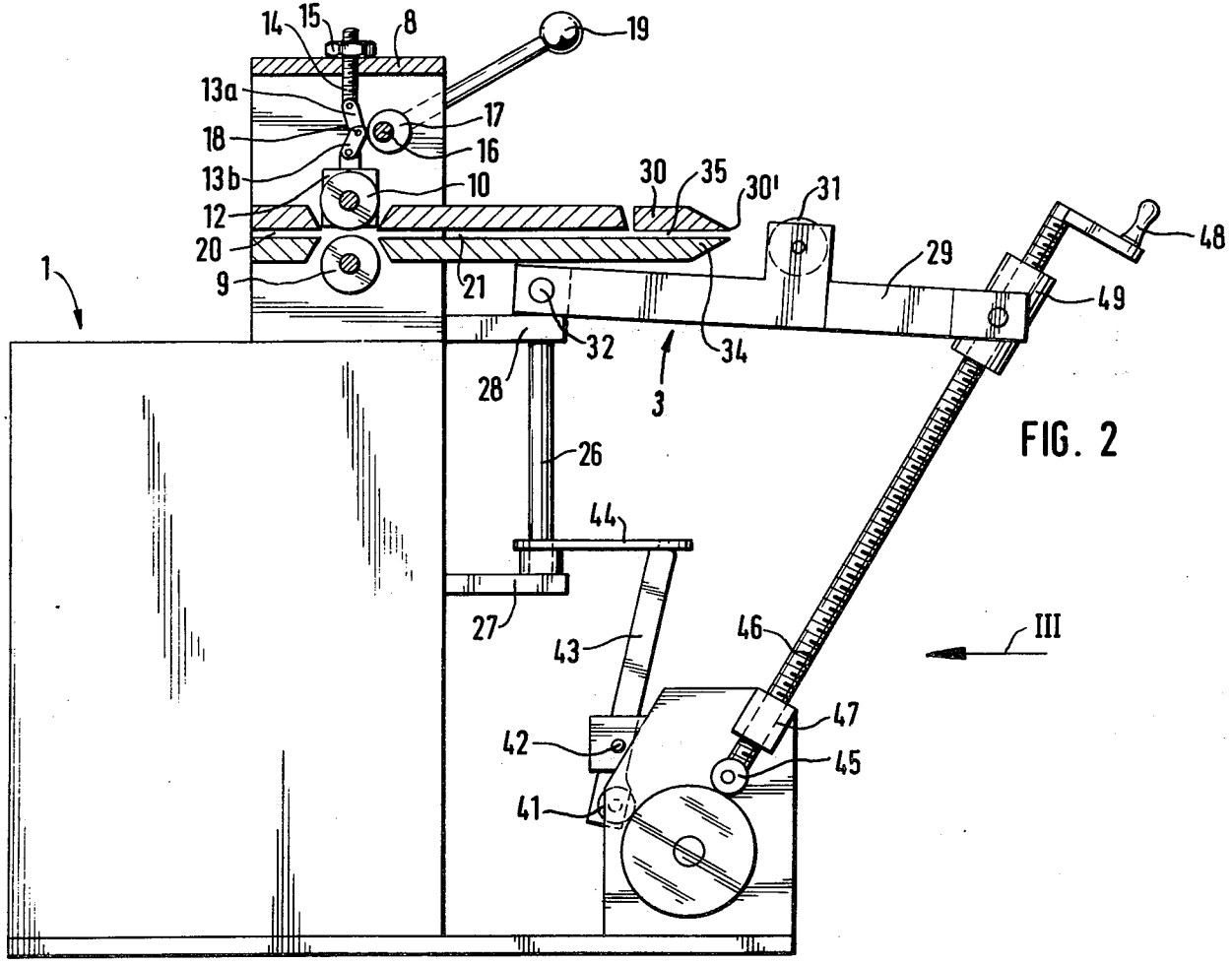
FIG. 2 is a partially sectioned side view in direction of the arrow II in FIGS. 1 and 3.
Figure 3:
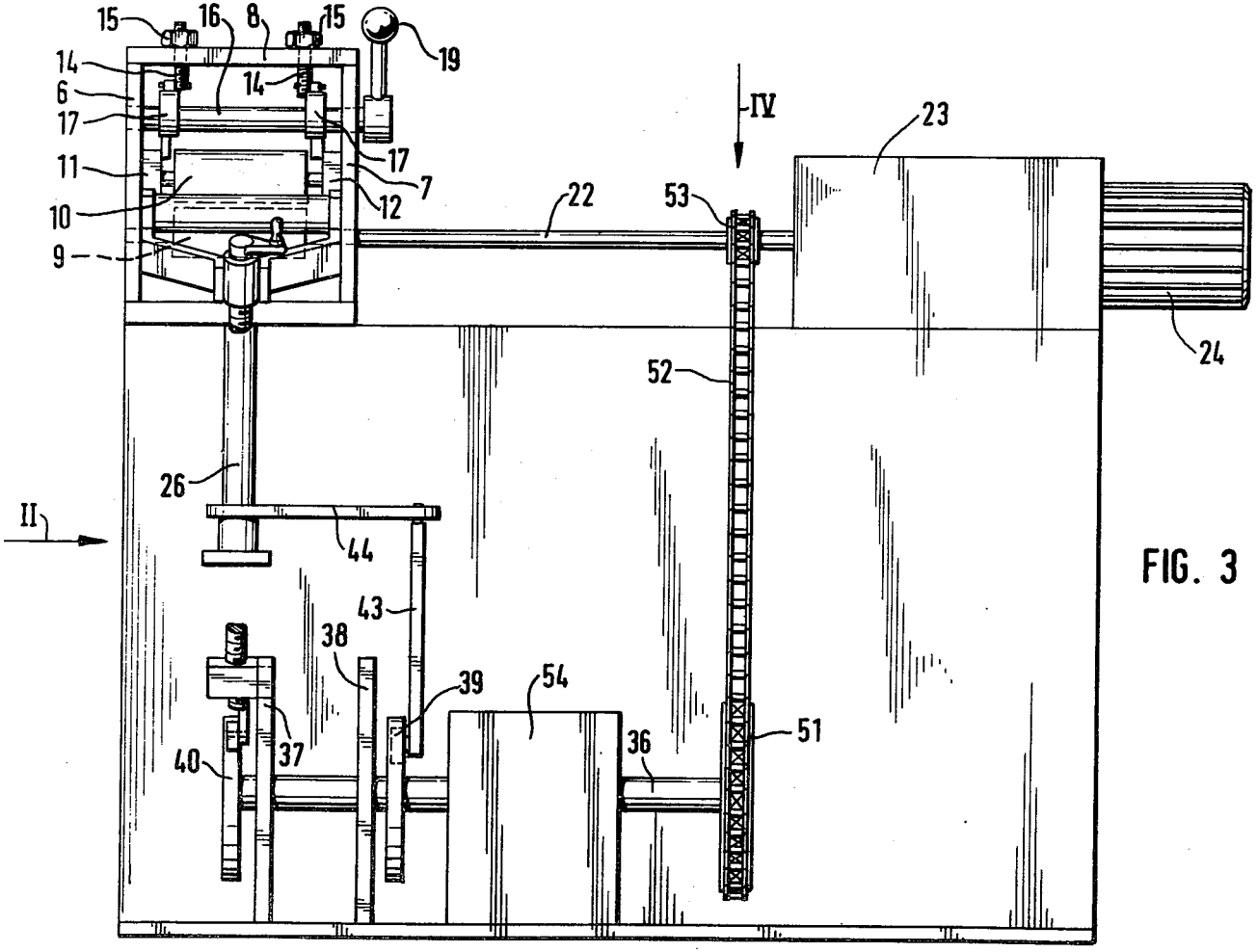
FIG. 3 is a front view in direction of the arrow III in FIGS. 1 and 4.
Figure 4:
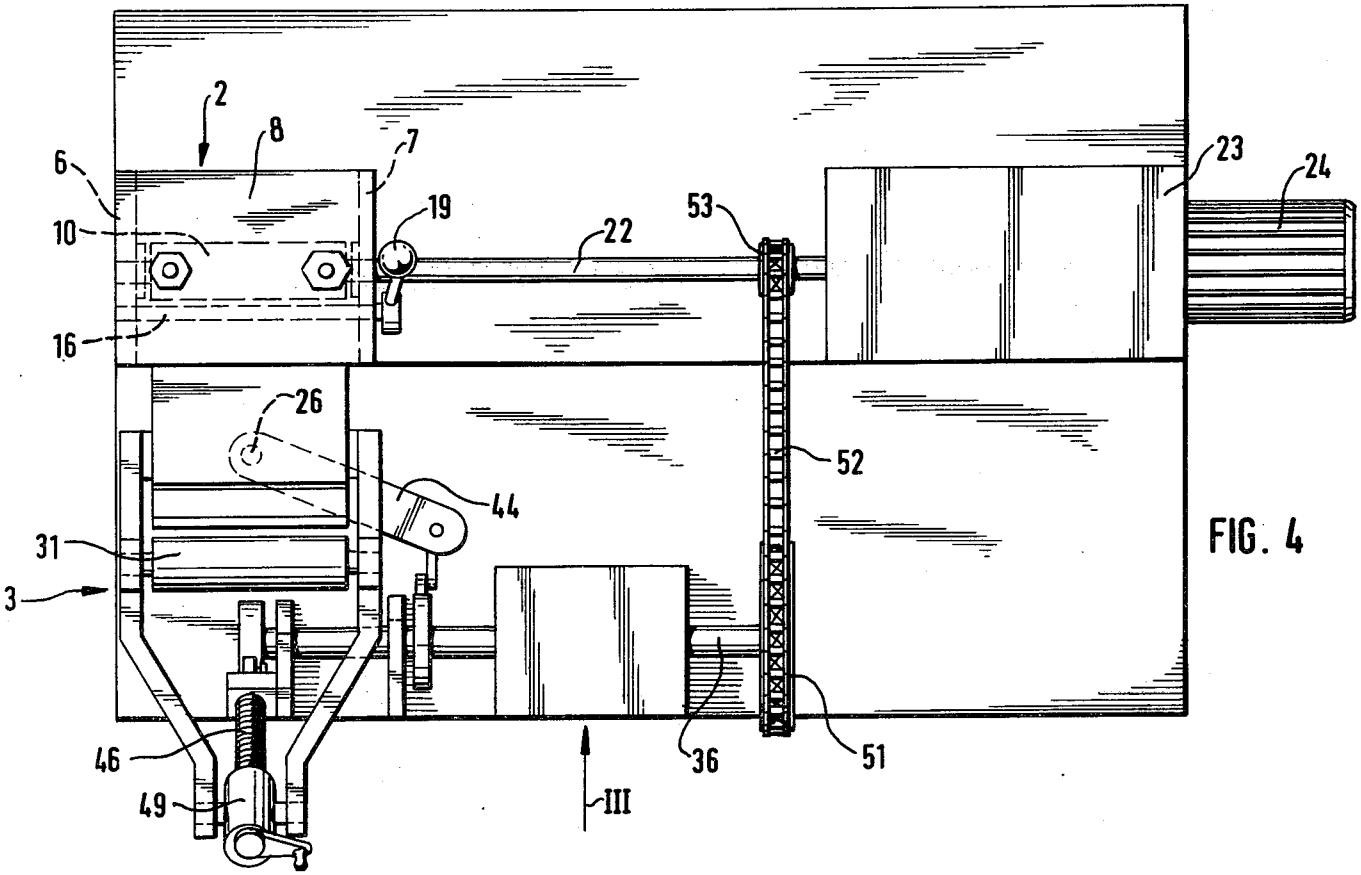
FIG. 4 is a top view in direction of the arrow IV in FIGS. 1 and 3.

The device which is best seen in FIG. 2 is used for effecting the vertical shifting of the upper feed roller 10. A toggle lever system with links 13*a*, 13*b* engages each of the bearings 11, 12. The upper end of the link 13*a* is hinged to a bolt 14, which can be adjusted relative to the upper plate 8 and can be fixed in every adjusted position by a nut 15. A horizontally extending shaft 16 is also rotatably supported in the side plates 6, 7 and has eccentrics 17 mounted thereon. The eccentric 17 engages the toggle lever system in the area of the joint 18, at which the toggle links 13*a*, 13*b* are pivotally connected together. A hand lever 19 is fixedly connected with respect to rotation to the shaft 16. It is easily clear from looking in particular at FIG. 2, that when the shaft 16 is rotated by means of the hand lever 19, the toggle lever system is pressed into an extended position and thus the bearings 11, 12 are pressed downwardly, particularly under a very large force, since a triple power transmission exists, namely one through the length of the hand lever 19, then through the eccentricity of the eccentrics 17 and finally through the geometry of the toggle lever system 13*a*, 13*b*.

A guide slot 20 for the strip which is to be processed is arranged in front of the feed roller pair 9, 10. A stationary guide slot 21 is also provided behind the feed roller pair.

The lower feed roller 9, 10 can be driven through a shaft 22. The shaft 22 is connected to the output from a reduction gearing inside a gear reducer housing 23, which reduction gearing may for example be a variable gearing. The drive is provided by means of an electric motor 24, which is mounted to the gear reducer housing 23.

The rocker arm 3 includes a frame 25, which consists of offset side parts 29 and a cross piece 30 connected therebetween. Below the cross part 30 there is provided a further cross part 34, which together with the part 30 forms a slot 35 therebetween and which is in alignment with the guide slots 20 and 21. The trailing edge 30' of the cross part 30 forms a bending edge which cooperates with the bending roller 31. The bending roller 31 is supported between the side parts 29. The frame 25 can be pivoted about pins 32 secured to the side parts 29 and slidingly extending into recesses provided in the ends of a transversely extending member 33. The transversely extending member 33 in turn is fixedly connected to and rotatable with a shaft 26 which is supported in bearings 27 and 28 on the machine frame 1.

The drive mechanism 4 for swinging the rocker arm 3 about the axes 32 and 26 includes a shaft 36 rotatably supported in bearing blocks 37, 38. Cam plates 39 and 40 are mounted on the shaft 36. A roller 41 engages the cam plate 39, which roller is arranged on a key lever 43 which is pivotally supported at 42 to the bearing block 38. The key lever 43 is hingedly connected to a lever 44, which in turn is fixedly connected to and rotatable with the shaft 26.

A feeler roller 45 engages the cam plate 40 and is arranged at the end of a push rod 46. The push rod 46 is guided in a guide bearing 47.

The push rod 46 is constructed as a threaded spindle with a handcrank 48. The spindle engages a nut 49 secured by means of pins to the frame 3, namely to the side parts 29 thereof which are positioned closely together.

A chain sprocket 51 is mounted on the shaft 36 and is connected to a chain sprocket 53 through a chain 52. The chain sprocket 53 is mounted on the shaft 22. An intermediate gearing 54 is arranged between the chain sprocket 51 and the cam plates 39, 40, which intermediate gearing permits a change of the transmission ratio.

OPERATION

The inventive device operates as follows:

A bearing block for supporting a roll of the strip material, for example of steel strip, is arranged behind the device (on the left side of the device in FIG. 2). The steel strip is introduced into the guide slots 20 and 21 with the upper feed roller 10 raised. After passage of the strip between the feed rollers 9, 10, the hand lever 19 is operated and thus the upper feed roller 10 is fixedly pressed against the strip so that the strip is strongly clamped between the rollers 9, 10. Depending on the desired coil, a certain transmission ratio is adjusted between the chain sprockets 53, 51 for selecting a suitable chain sprocket 51. The cam plates 39, 40 are also adjusted to the desired dimensions of the coil.

If the drive is now started by switching on the motor 24, the strip is advanced through the guide slots 21, 34 against the bending roller 31 and the rocker arm 3 is in its position which is the uppermost one for the respective manufacture, because now first the smallest winding diameter is supposed to be manufactured. First, a cylindrical winding is produced and the bearing roller 31 is positioned parallel to the feed rollers 9, 10. During the further course of the manufacture, the rocker arm 3 is now continuously lowered, which causes the bending radius to be continuously enlarged. During the transition to the desired pitch of the spring, a pivoting about the shaft 26 is also carried out. In the area of the constant pitch, the pivoted position of the shaft 26 is maintained. If at the end of the finished product a cylindrical winding is to be produced again, then the rocker arm 3 again pivots about the shaft 26 into a position, in which the bending roller 31 is parallel to the feed rollers 9, 10.

Certain cam plates 39, 40 and a certain transmission ratio between the sprockets 53 and 51 must be adjusted for each certain coil dimension. When a machine has been adjusted one obtains precisely reproducable results. It is therefore possible to produce the coils with an optimum winding spacing so that on the one hand a perfect function of the coil is assured and on the other hand a coil diameter can be achieved which is as small as possible.

Instead of a cross movement of the bending roller 31 through lifting and lowering of a rocker arm, it would also be possible to use a rocker arm which can be pivoted only about an axis which is at a right angle to the strip, thus for example the shaft 26, while within the rocker arm there is provided a separate lifting and lowering mechanism for the bending roller 31.

It is particularly pointed out that it is possible, with the inventive machine, to form at the start and at the end of the coil one or several cylindrical windings without pitch and then to transfer continuously into the pitch progression. Important for this function is a very strong holding of the steel strip between the feed rollers 9, 10, for which reason a compression device having a very large translation is provided. This is a very important advantage compared with the conventional manufacture of conical coils by winding up onto a conical mandrel.

A machine has been described in connection with the drawings, in which the feed rollers 9, 10 are supported in a fixedly arranged frame 6, 7, 8, while the bending roller 31 for the purpose of changing the bending radius and the pitch of the coil to be produced is shifted. The arrangement could, however, also be reversed with the same effect, namely, one could fixedly arrange the bending roller and the frame 6, 7, 8 with the associated parts could be made correspondingly movable. Principally only the relative position between the bending roller and the feed device is important.

The invention differs with respect to such machines, with which material of circular cross section, as for example pipes or roll wire, is bent to form spirals. While it is possible in deforming round material to laterally fix same through a suitable profiling of the cross section of bending rollers, in the case of the inventive machine long, smooth rollers must be used. Holding of the relative wide and thin strip, which as a rule is made of steel, is not done form-lockingly like in the conventional bending apparatus, but clampingly by compression of the feed rollers and by guiding the strip in a narrow slot 21. The deforming operation cannot be compared with the deformation of round material.

We claim:

1. A machine for the manufacture, from a strip, of an axially prestressed coil for covering of machine parts, comprising a feed roller pair for feeding the strip by use of an associated feed drive mechanism, an adjusting device for adjusting one of said feed rollers to thereby change the gap between the two feed rollers, the feed rollers being movable against one another by a pressing device, a bending roller which is arranged in front of the feed roller pair, a bearing member for supporting one of the bending roller and the feed roller pair for pivotal movement by means of a swivel drive mechanism about an axis which extends perpendicularly to the plane of the strip which exits from the feed rollers and a shifting drive mechanism for shifting one of the bending roller and the feed rollers transversely to their axis and the feed drive mechanism, the swivel drive mechanism and the shifting drive mechanism being interconnected.

2. A machine according to claim 1, including means defining a guide gap for the strip between the feed roller pair and the bending roller.

3. A machine according to claim 2, wherein said guide gap defining means include parts which define the end of the guide gap, which end is adjacent to the bending roller.

4. A machine according to claim 1, wherein the bending roller has a bearing supported for movement transversely to the axis of the bending roller.

5. A machine according to claim 1, wherein the bearing member for the bending roller is pivotable about a pitch axis which is parallel to the bending roller.

6. A machine according to claim 1, wherein at least one of the swivel drive mechanism and the shifting drive mechanism has control cams in the form of one of curve templates and cam plates.

7. A machine according to claim 6, including shaft means mounting the control cams for exchangeability with other control cams of different contour.

8. A machine according to claim 5, in which said swivel drive mechanism and shifting drive mechanism include cam plates arranged on a common shaft for pivoting the bearing member about said axis perpendicular to the plane of the strip and also about said pitch axis, respectively, and feelers resting on the cam plates, and linkage means connecting said feelers to the bearing member.

9. A machine according to claim 8, wherein at least the linkage for pivoting around the pitch axis is longitudinally changeable.

10. A machine according to claim 8, wherein the feed drive mechanism is coupled with the cam plate shaft through a variable transmission mechanism.

11. A machine according to claim 1, wherein the drive mechanisms have each separate drive means, which are coupled through a control device.

12. A machine according to claim 1, wherein the pressing device has toggle levers engaging bearings supporting a said movable feed roller.

13. A machine according to claim 12, including an adjusting shaft with a hand lever, on which an eccentric is provided, said eccentric engaging the joint of said toggle lever.

14. A machine according to claim 1, including a rotatably movable and longitudinally movable abutment for the forward moving coil end.

15. A machine according to claim 1, wherein the sloped position of the bending roller is inclined relative to the bending edge which cooperates with it and the sloped position angle is adjustable.

* * * * *